US006503622B1

(12) United States Patent
Yoshimura et al.

(10) Patent No.: US 6,503,622 B1
(45) Date of Patent: Jan. 7, 2003

(54) TEXTURIZED, COMBINED POLYESTER MULTIFILAMENT YARN AND PROCESS FOR PRODUCING SAME

(75) Inventors: Mie Yoshimura, Matsuyama (JP); Kimihiro Ogawa, Matsuyama (JP); Koichi Iohara, Matsuyama (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/868,786

(22) PCT Filed: Oct. 20, 2000

(86) PCT No.: PCT/JP00/07352

§ 371 (c)(1), (2), (4) Date: Jun. 21, 2001

(87) PCT Pub. No.: WO01/29294

PCT Pub. Date: Apr. 26, 2001

(30) Foreign Application Priority Data

Oct. 22, 1999 (JP) ..... 11-300618

(51) Int. Cl.[7] ..... D01F 6/00

(52) U.S. Cl. ..... 428/364; 428/395; 428/370; 364/103; 364/171.1; 364/210.5

(58) Field of Search ..... 428/364, 395, 428/370; 264/103, 171.1, 210.5, 210.8, 211.12

(56) References Cited

FOREIGN PATENT DOCUMENTS

| | | | |
|---|---|---|---|
| CN | 1222945 | 7/1999 | |
| EP | 0 049 412 | 4/1982 | ..... D01F/6/92 |
| EP | 0908544 | 4/1999 | |
| JP | 58-98418 | 6/1983 | ..... D01F/6/62 |
| JP | 63042913 | 2/1988 | |
| JP | 11350277 | 12/1999 | |
| WO | WO99/47735 | 9/1999 | ..... D01F/6/62 |

*Primary Examiner*—Newton Edwards
(74) *Attorney, Agent, or Firm*—Sughrue Mion, PLLC

(57) ABSTRACT

A texturized, combined polyester multifilament yarn formed from two types of polyester multifilaments FYA and FYB different in polymer chemical composition from each other and appropriately intermingled with each other, in which yarn, the multifilaments FYB have an average filament length in straightened form of 8 to 40% longer than that of the multifilaments FYA, the coefficient of variation ($CV_A$) of the filament length of FYA is 3% or less, and coefficient of variation ($CV_{B-A}$) in difference between the individual filament lengths of the FYB and the average filament length of the FYA is 10 to 20%. The yarn exhibits a high bulkiness and a large filament yarn difference and is free from slippage between the sheath FYB layer and the core FYA portion.

10 Claims, No Drawings

TEXTURIZED, COMBINED POLYESTER MULTIFILAMENT YARN AND PROCESS FOR PRODUCING SAME

TECHNICAL FIELD

The present invention relates to a texturized, combined polyester multifilament yarn and a process for producing the same. More particularly, the present invention relates to a texturized, combined polyester multifilament yarn comprising two or more types of texturized polyester multifilaments, different in polymer composition thereof from each other, combined with each other to form a combined yarn and having an enhanced bulkiness, and a process for producing the yarn.

BACKGROUND ART

Currently various types of texturized polyester multifilament yarns are produced from two or more types of polyester multifilaments different in elongation and/or thermal shrinkage from each other by draw-false twisting or drawing procedures in which the two or more different types of undrawn multifilaments are processed altogether. In this procedure, a difference in real filament length between the two or more different types of multifilaments is increased due to the differences in the elongation property and thermal shrinkage property between them, to thereby expand the gap spaces between the texturized individual filaments contained in the combined yarn and to enhance the bulkiness of the resultant texturized, combined multifilament yarn.

The term "real filament length" means a length of a filament in a straightened condition.

The two or more types of undrawn polyester multifilaments different in elongation and/or thermal shrinkage and usable for the production of the texturized multifilament yarn are briefly classified into the following two groups.

Group 1

Two or more different types of multifilaments are. melt-spun through melt-spinning orifices; and then the resultant undrawn multi-filaments are separately wound up around two or more different bobbins. These yarns are referred to as separately wound multifilament yarns.

Group 2

Two or more different types of multi-filaments are melt-spun through melt-spinning orifices; the resultant undrawn individual multifilaments are combined with each other; and the combined multifilaments are wound around a single bobbin. The yarn is referred to as a melt-spun, combined multifilament yarn.

The separately wound multifilament yarns (group 1) are advantageous in that since the melt-spun multifilament yarns are wound separately from each other, and thus the polymer composition of and yarn-production conditions for each yarn can be widely varied, variety in combinations of the different types of the multifilaments can be significantly enhanced. However, the separately wound multifilament yarns are disadvantageous in that, in the production of two or more different types of multifilament yarns, two or more separate apparatuses are necessary, and thus the productivity of the combined multifilament yarn is low. Also, the separately wound multifilament yarns are disadvantageous in that when the two or more different types of separately wound multifilaments are combined with each other to form a combined yarn, it is difficult to smoothly combine the individual multifilaments with each other during the texturized yarn-forming procedure, and the multifilaments which have a longer filament length and should be mainly located in an outer layer of the resultant texturized, combined multifilament yarn to serve as sheath filaments for the yarn, are not fixed around other multifilaments which have a shorter filament length and should be mainly located in an core portion of the resultant textured, combined multifilament yarn to serve as core filaments for the yarn, and thus the longer filament length sheath filaments do not contribute to sufficiently enhancing the bulkiness of the resultant texturized, combined multifilament yarn.

The melt-spun, combined multifilament yarn (group 2) is advantageous in that since a plurality of types of multifilaments are wound to form a single package, the combined multifilament yarn can be produced by a single melt-spinning apparatus; and since the plurality of types of the melt-spun multifilaments are combined before the winding procedure, the melt-spun individual multifilaments are easily combined with each other; and in the resultant texturized, combined multifilament yarn, the longer filament length multifilaments can be easily located in the outer layer of the resultant yarn to serve as sheath filaments and contribute to enhancing the bulkiness of the resultant yarn. However, since the melt-spun, combined multifilament yarn is produced by a single melt-spinning apparatus, the melt-spinning conditions, for a plurality of types of the multifilaments, are difficult to change widely and independently; large differences in the elongation property and shrinkage property are difficult to produce between the two or more types of the multifilaments; and thus production of a texturized, combined multifilament yarn in which the difference in real filament length between the two or more types of multifilaments is large enough to obtain a high bulkiness of the yarn, is difficult.

Japanese Unexamined Patent Publication No. 58-98418 discloses a process in which only the advantages of both the separately wound multifilaments and the melt-spun, combined multifilaments appear. In this process, a specific polymer, for example, a polymethyl methacrylate, is added to one type of multifilaments for a combined multifilament yarn, to thereby greatly increase the elongation of the polymethyl methacrylate-added multifilaments in comparison with that of the non-polymethyl methacrylate-added multifilaments, and thus a texturized combined multifilament yarn having a large difference in real filament length between two or more types of multifilaments, which large difference was believed to be unobtainable by the conventional melt-spun, combined multifilaments, can be obtained.

However, the inventors of the present invention studied the above-mentioned process and found that in a stage of the process in which a difference in the real filament length is created between the two or more types of melt-spun multifilaments, the combination of the individual melt-spun multifilaments with each other proceeds to an excessive extent, and thus the combined melt-spun individual multifilaments are restricted in the movement in relation to each other; thus, the longer filament length multifilaments are difficult to be located in the outer layer of the resultant combined yarn; and the resultant combined yarn exhibit an insufficient bulkiness, even when the filament length difference, per se, is large.

Japanese Unexamined Patent Publication No. 63-42,913 discloses a copolymerization of isophthalic acid into a polyester molecule chain, in place of an addition of polymethyl methacrylate. According to the publication, the copolymerization of isophthalic acid contributes to increasing the difference in shrinkage between two or more types of melt-spun multifilaments in the melt-spun, combined multifilament yarn and enables the resultant bulky texturized yarn to exhibit a large difference in the real filament length between the two or more types of multifilaments, similar to that in Japanese Unexamined Patent Publication No 58-98418. However, it has been found by the inventors of the present invention that in the production of the bulky texturized multifilament yarn of Japanese Unexamined Patent Publication No. 63-42913, in which isophthalic acid is employed, the melt-spun multifilaments are combined to an excessive extent in the stage of creating the difference in the real filament length between two or more types of multi-filaments, and thus the resultant texturized, combined multifilament yarn exhibits an unsatisfactory bulkiness even when a large filament length difference is created. Accordingly, the conventional art has not yet succeeded to provide a texturized, combined polyester multifilament yarn in which longer multifilaments are satisfactorily located in the outer layer of the yarn to form a bulky sheath layer, the difference in the filament length between two or more types of multifilaments is sufficiently large and the bulkiness of the resultant combined yarn is satisfactory.

DISCLOSURE OF THE INVENTION

An object of the present invention is to provide a texturized, combined polyester multifilament yarn in which a difference in filament length between two types of polyester multifilaments is large, and an outer layer thereof is mainly formed from polyester multifilaments having larger filament length to enable the resultant yarn to exhibit a high bulkiness, and a process for producing the bulky yarn.

The above-mentioned object can be attained by the textured, combined polyester multifilament yarn, and the process for producing the same, of the present invention.

The textured, combined polyester multifilament yarn of the present invention comprises two types of texturized polyester multifilaments FYA and FYB different in polymer chemical composition thereof from each other and combined and intermingled with each other to form a combined multifilament yarn FY, wherein average filament length under a straightened condition of the individual multifilaments FYB is 8 to 40% longer than that of the individual multifilaments FYA in the combined multifilament yarn FY, the shorter individual multifilaments FYA have a coefficient of variation ($CV_A$) in filament length under straightened condition of 3% or less, and a coefficient of variation ($CV_{B-A}$) in difference between the individual filament lengths of the longer individual multifilaments FYB and the average filament length of the shorter individual multifilaments FYA each under straightened condition is in the range of from 10 to 20%.

In the texturized, combined polyester multifilament yarn of the present invention, the longer multifilaments FYB preferably contain a filament elongation-enhancing agent in an amount of 0.5 to 5% by weight based on the weight of the polyester polymer contained in the longer multifilaments FYB.

In the texturized combined polyester multifilament yarn of the present invention, the filament elongation-enhancing agent preferably comprises an addition polymerization product of at least one unsaturated monomer, which product is substantially insoluble in the polyester in the longer individual filaments FYB and has a weight average molecular weight of at least 2000.

In the texturized, combined polyester multifilament yarn of the present invention, the polyester contained in the shorter individual multifilaments FYA preferably contains, as a portion of a residue of a dicarboxylic acid component for forming the polyester, isophthalic acid residue in an amount of 3 to 15 molar % of the total content of dicarboxylic acid residues.

In the texturized combined polyester multifilament yarn of the present invention, the longer polyester multifilaments FYB preferable have an average individual filament thickness corresponding to 80% or less of that of the shorter polyester multifilaments FYA, and the number of the longer polyester multifilaments FYB is preferably at least 1.5 times that of the shorter polyester multifilaments FYA, per one combined ultifilament yarn FY.

The process of the present invention for producing a texturized, combined polyester multifilament yarn, comprises the steps of:

separately melt-spinning two types of polyesters, different in chemical composition from each other, respectively through melt-spinning holes for the two types of polyesters to separately provide two types of undrawn polyester multifilaments;

combining the two different types of multifilaments with each other, while subjecting the two different types of multifilaments to a filament-intermingling treatment in which an air blast is applied to the combined multifilaments under an air pressure of 50 to 600 kPa, to intermingle the individual multifilaments with each other;

taking up the resultant combined, intermingled multifilament bundle;

drawing the multifilament bundle at a draw ratio of 1.2 to 2.5, to provide a combined, intermingled and drawn multifilament yarn comprising two types of drawn multifilament different in thermal shrinkage from each other; and applying a heat texturizing treatment to the drawn multifilament yarn to such an extent that a type of resultant texturized multifilaments FYB have an average filament length under straightened condition of 8 to 40% longer than that of the other type of the resultant texturized multifilaments FYA, in the resultant multifilament yarn FY, the shorter individual multifilaments FYA exhibits a coefficient of variation ($CV_A$) in filament length under straightened condition of 3% or less, and a coefficient of variation ($CV_{B-A}$) in difference between the filament lengths of the longer individual multifilaments FYB and the average filament length of the shorter individual multifilaments FYA each under straightened condition is in the range of from 10 to 20%.

In the process of the present invention, the air filament-intermingling treatment is preferably effected by an interlace method.

In the process of the present invention, the spinning holes for the two types of polyesters are preferably formed in one single spinneret plate. Best Mode of Carrying out the Invention The inventors of the present invention have made an extensive study for attaining an appropriate combination of the two different types of melt-spun polyester multifilaments contained in the melt spun, combined multifilament yarn before taking up and winding the combined yarn. As a result, it was found that during the melt-spinning, combining procedures (before the taking up and winding procedures), an application of an air blast to the combined multifilaments under an air pressure of 50 to 600 kPa contributes to intermingling the combined multifilaments with each other and to controlling the degree of combination to an appropriate level, and the resultant texturized, combined polyester multifilament yarn exhibits a high bulkiness. The special filament-intermingling treatment under a specific air blast pressure of the present invention is new and the advantages derived from the special filament-intermingling treatment were not known in the prior art.

The texturized, combined polyester multifilament yarn of the present invention comprises two types of texturized polyester multifilaments FYA and FYB different in polymer chemical composition thereof from each other and combined and intermingled with each other to form a combined multifilament yarn FY. The difference in polymer chemical composition includes differences in the type and content of the recurring units of the polyester molecules, the type of additives contained in the polyester resin and the type and content of comonomers.

In the texturized, combined polyester multifilament yarn FY, the average length of the individual multifilaments FYB in a straightened form is 8 to 40% longer than that of the individual multifilaments FYA in a straightened form. The difference in the average filament length between the texturized multifilaments FYA and FYB in the texturized, combined multifilament yarn FY is defined by the following equation.

$$\Delta L\ (\%) = \frac{(L_B) - (L_A)}{(L_A)} \times 100$$

wherein ΔL represents a difference in average filament length between the texturized multifilaments FYB and FYA each in straightened form and contained in the texturized, combined multifilament yarn FY having a certained length, $L_B$ represents an average filament length of the longer texturized multifilaments FYB in straightened form, and $L_A$ represents an average filament length of the shorter texturized multifilament FYA in straightened form.

The ΔL may be referred to as an average filament length difference.

The texturized, combined multifilament yarn FY of the present invention has a core portion formed mainly from the texturized shorter multifilaments FYA and an outer (sheath) layer surrounding the core portion and mainly formed from the texturized longer multifilaments FYA, the shorter and longer multifilaments FYA and FYB are partially intermingled with each other to form a combined multifilament yarn.

When the average filament length difference is less than 8%, the texturized longer multifilaments FYB mainly located in the sheath layer cannot form large spaces between the individual multifilaments FYB and FYA sufficient to impart a high bulkiness to the combined multifilament yarn. Also, when the average filament length difference is more than 40%, connecting points between the texturized shorter multifilaments FYA mainly located in the core portion and the texturized longer multifilaments FYB mainly located in the sheath layer are decreased and as a result, the sheath layer cannot be fixed around the core portion of the combined multifilament yarn, and the individual multifilaments in a plurality of combined yarns brought into contact with each other are easily intertwined with each other. This intertwining phenomenon is referred to as "a fastener phenomenon". The average filament length difference is preferably 10 to 30%.

In the texturized, combined polyester multifilament yarn of the present invention, the problems, namely an unsatisfactory bulkiness, of the prior art combined multifilament yarns produced from the melt-spun, combined multifilament yarn are completely solved.

In the texturized, combined polyester multifilament yarn FY of the present invention, the shorter individual multifilaments FYA have a coefficient of variation ($CV_A$) in filament length under straightened condition of 3% or less, and a coefficient of variation ($CV_{B-A}$) in difference between the average filament length of the longer individual multifilaments FYB and the shorter individual multifilaments FYA each under straightened condition is in the range of from 10 to 20%.

The coefficient of variation $CV_{B-A}$ in % is determined by the following measurement.

A sample of the texturized, combined multifilament yarn FY is cut to 5 cm length, the texturized shorter and longer multifilaments FYA and FYB in the yarn FY are separated from each other. Differences in filament length between 50 longer multifilaments FYB and 50 shorter multifilaments FYA are measured, and an average filament length difference is calculated from the measurement data. Also, a standard deviation of the measured differences between the individual filament lengths of the longer individual multifilaments FYB and the average filament length of the shorter individual multifilaments FYA is calculated. The coefficient of variation $CV_{B-A}$ is a quotient in % of the standard deviation of the filament length differences between the longer and shorter multifilaments FYB and FYA divided by the average filament length difference. In the present invention, the $CV_{B-A}$ must be 10 to 20%. For reference, the $CV_{B-A}$ of the texturized combined polyester multifilament yarn disclosed in Example 1 of Japanese Unexamined Patent Publication No. 58-98418 using melt-spun, combined multifilament yarns is 28%, and the $CV_{B-A}$ of the texturized, combined polyester multifilament yarn formed from separately wound multifilaments is 8%.

When the $CV_{B-A}$ is more than 20%, the shorter and longer multifilaments FYA and FYB are combined to an excessive extent, and thus are excessively restricted in movement thereof with each other. Thus even when the filament length difference between the multifilaments FYA and FYB is large, the spaces formed between the multifilaments FYA and FYB are not large enough to enable the resultant combined multifilament yarn to exhibit a high bulkiness. Also, when the $CV_{B-A}$ is less than 10%, the shorter and longer multifilaments FYA and FYB are insufficiently combined with each other and thus the sheath layer mainly formed from the longer multifilaments FYB are not firmly fixed to the core portion formed mainly from the shorter multifilaments FYA. Namely, the sheath layer easily slips out from the core portion of the combined multifilament yarn.

In the present invention, an unexpected advantage such that the resultant texturized, combined multifilament yarn of the present invention produced from the melt-spun, combined multifilament yarn containing two types of multifilaments exhibits a higher bulkiness than that of the conventional texturized, combined multifilament yarn produced from two types of separately wound multifilaments having the same average filament length difference as that of the present invention. Namely, in the present invention, the control of the combination degree of the two different types of multifilaments by applying the air blast treatment enables not only the two different types of multifilaments in the melt-spun, combined multifilament yarn to be combined with each other in an appropriate condition close to that of the separately wound multifilament yarn, but also enables the resultant texturized, combined multifilament yarn to exhibit a higher bulkiness than that produced from the separately wound multifilament yarns.

The mechanism of creating the high bulkiness of the texturized, combined multifilament yarn is not fully clear. The mechanism is, however, assumed to be as follows.

Namely, in the case where the separately wound multifilament yarns are employed, the resultant texturized combined multifilament yarn has large spaces formed between the multifilaments FYA and FYB, but since the filament length of the multifilaments FYB mainly located in the sheath layer is uniform, the above-mentioned spaces are concentrated between the core portion and the sheath layer of the combined multifilament yarn, the sheath layer mainly formed from the longer multifilaments FYB around the core portion cannot maintain the surrounding layer around the core portion and approaches the core portion so that the spaces between the sheath layer and the core portion are lost. In the texturized, combined multifilament yarn of the present invention, since the filament length of the longer multifilaments FYB is distributed in an appropriate range, the spaces formed between the multifilaments FYA and FYB are not concentrated between the sheath layer and the core portion of the combined multifilament yarn, and thus the spaces formed between the multifilaments FYA and FYB due to the filament length difference can be utilized to the maximum. The larger the filament length difference between the shorter and longer multifilaments FYA and FYB, the higher the restriction effect for concentration of the spaces between the sheath layer and the core portion. Thus, in view of the above-mentioned fact, the average filament length difference between the shorter and longer multifilaments FYA and FYB is preferably 10 to 30%.

The shorter multifilaments FYA are mainly located in the core portion of the combined multifilament yarn. Thus, when a stretching load is applied to the texturized, combined multifilament yarn, the shorter multifilaments FYA serve as a stress-carrier. Therefore, the scattering in the filament length of the shorter multifilaments FYA is preferably as small as possible. When a sample of the texturized, combined polyester multifilament yarn is cut into a length of 5 cm, and the filament length of the shorter multifilaments in straightened form is measured, the coefficient of variation ($CV_A$) in the filament length under straightened condition of the shorter individual multifilaments FYA is controlled to 3% or less.

The polyester resin usable for the present invention is preferably selected from polyethylene terephthalate, polytrimethylene terephthalate, polytetramethylene terephthalate, polyethylene-2,6-naphthalate and copolymers of two or more of the component monomers of the above-mentioned polyesters and mixtures of two or more of the above-mentioned polyesters and copolymers. More preferably, the polyester usable for the present invention is selected from polyesters containing recurring ethylene terephthalate units in an content of 80 molar % based on the total molar recurring unit amount, which polyester is easily formed into filaments. Also, the polyester resin may contain at least one additive selected from delustering agents, pigments, flame retardants, deodorizers, antistatic agents, antioxidants and ultraviolet ray-absorbing agents, unless the additive hinders the attainment of the object of the present invention.

To obtain a satisfactory filament length difference between the longer and shorter multifilaments YFB and YFA, preferably, the longer multifilaments FYB contains a filament elongation-enhancing agent for enhancing the elongating property of the multifilaments FYB, and the shorter multifilaments FYA contains a filament shrinkage-enhancing agent for increasing the thermal shrinking property of the multifilament FYA.

The multifilaments FYB containing the filament elongation-enhancing agent are preferably employed in combination with the multifilaments FYA containing the filament shrinkage-enhancing agent.

The filament elongation-enhancing agent is contained in an amount of 0.5 to 5% by weight based on the polyester resin weight of the longer multifilaments FYB. If the content of the filament elongation-enhancing agent is less than 0.5% by weight, the filament elongation enhancing effect on the longer multifilaments FYB may be insufficient and thus a satisfactory filament length difference between the shorter and longer multifilaments FYA and FYB may not be obtained. Also, if the content of the filament elongation-enhancing agent is more than 5% by weight, the filament elongation effect on the longer multifilaments FYB may be saturated, breakages of the multifilaments during the melt spinning procedure may increase so that the production procedure of the combined yarn may be unstable. The filament elongation-enhancing agent may be contained in a small amount in the shorter multifilaments FYA. The content of the filament elongation-enhancing agent in the shorter multifilaments FYA is preferably limited to a level of 1.5% by weight or less and of 0.5% by weight below the content of the filament elongation-enhancing agent in the longer multifilaments FYB.

The filament elongation-enhancing agent preferably comprises an addition polymerization product of at least one unsaturated monomer, which product is substantially insoluble in the polyester in the longer individual filaments FYB and has a weight average molecular weiaht of at least 2000. If the filament elongation-enhancing agent is soluble in the polyester and/or the molecular weight of the agent is less than 2000, a satisfactory filament elongation-enhancing effect on the longer multifilaments FYB may not be obtained.

The addition polymerization products of the unsaturated monomer usable for the filament elongation-enhancing agent are preferably selected from polymethacrylate polymers, polyacrylate polymers, poly(4-methyl-1-pentene) polymers, polyoctadecene-1 polymers and polyvinyl benzyl polymers styrene polymers and styrene derivative polymers. Preferably, the filament elongation-enhancing agent has a thermal deformation temperature of 110 to 130° C., which is higher than the glass transition temperature of the polyester, and which causes that when the polyester melt containing the filament elongation-enhancing agent is extruded through a melt-spinning orifice, the filament elongation-enhancing agent contained in the extruded filamentary polyester melt stream can be solidified in an upstream portion of the melt-spinning path. If the thermal deformation temperature is less than 110° C., the difference between the thermal deformation temperature and the glass transition temperature of the polyester is small, and thus the filament elongation-enhancing effect on the multifilaments FYB is low. Also if the thermal deformation temperature is higher than 130° C., the filament elongation-enhancing agent contained in the filamentary polyester melt stream extruded through the melt-spinning orifice is rapidly solidified immediately after passing through the melt-spinning orifice, thus the solidification of the polyester melt does not occur at the same time as the solidification of the filament elongation-enhancing agent, and this phenomenon causes the breakages of the extruded filamentary polyester melt streams to increase. The filament elongation-enhancing agent usable for the present invention is disclosed in WO 99/47735.

To enhance the thermal shrinkage of the shorter multifilaments FYA, preferably the dicarboxylic acid residue contained in the shorter multifilaments FYA is substituted in an amount of 3 to 15 molar %, based on the total content of the dicarboxylic acid residue by a bisphenol A residue, a isophthalic acid residue or a residue of a derivative of bisphenol A or isophthalic acid, having at least one metal sulfonate salt group attached, as a side chain, to the aromatic group of the bisphenol A or isophthalic acid.

If the content of the substituent is less than 3 molar %, the filament shrinkage-enhancing effect on the shorter multifilaments FYA may be unsatisfactory. Also, if the substitution is more than 15 molar %, the filament shrinkage-enhancing effect may be saturated and the breakages of the filaments during the melt-spinning procedure may increase.

The above-mentioned filament elongation-enhancing agent may be contained in the shorter multifilaments FYA and the above-mentioned filament shrinkage-enhancing means may be applied to the longer multifilaments FYB, as long as the satisfactory filament length difference between the shorter and longer multifilaments FYA and FYB is obtained. Also, as long as the requirements on the $CV_A$ of the shorter multifilaments FYA and the $CV_{B-A}$ between the longer and shorter multifilaments FYB and FYA are satisfied, the multifilaments FYA or FYB may contain those having an irregular cross-sectional profile or may contain two or more types multifilaments different in thickness from each other.

When the texturized, combined polyester multifilament yarns of the present invention are employed to produce a fabric, the sheath layers of the yarn mainly formed from the longer multifilaments FYB impart a soft hand to the resultant fabric, and the core portions of the yarns mainly formed from the shorter multifilaments FYA imparts a hard hand (or rigid hand or elastic hand) to the fabric. Thus, preferably, the thickness of the individual longer multifilaments FYB is 80% or less of the thickness of the individual shorter multifilaments FYA, and the number of the individual filaments of the longer multifilaments contained in a yarn is at least 1.5 times that of the shorter multifilaments FYA. More preferably, the longer multifilaments FYB have an individual filament thickness of 0.5 to 1.5 dtex and have a number of filaments per yarn of 24 to 96. Also, preferably, the shorter multifilaments FYA have an individual filament thickness of 1 to 6 dtex and the number of filaments per yarn of 12 to 36.

In the texturized, combined polyester multifilament yarn of the present invention, in the case where the yarn is a non-crimped yarn or a crimped yarn having a low percentage of crimp of less than 2%, the number of intermingling points, of the multifilaments FYA and FYB, is preferably 30 to 60 per meter of the yarn. In the case where the percentage of crimp of the yarn is 2 to 12%, the intermingling point number is preferably 15 to 40 per m of the yarn. When the percentage of crimp of the yarn is less than 2%, the resultant yarn is free from a rough hand and has a very soft hand, but slippage between the sheath layer-forming filaments and the core portion-forming filaments occurs easily. Therefore, in this case, the intermingling point number is preferably 30 or more per m of the yarn. However, if the intermingling point number is more than 60 per m of the yarn, the resultant yarn may exhibit stiff hand. Where the percentage of crimp of the yarn is 2 to 12%, the crimp of the yarn causes the bulkiness of the yarn to increase and thus the resultant yarn exhibits a significantly enhanced bulkiness. Also, the crimps cause slippage between the sheath layer-forming filaments and the core portion-forming filaments to be restricted in comparison with the non-crimped yarn. Thus, in this case, the intermingling point number is preferably in the wide range of from 15 to 40 per m of the yarn.

The process of the present invention for producing the texturized, combined polyester multifilament yarn will be explained below.

The process of the present invention comprises the steps of:

separately melt-spinning two types of polyesters different, in chemical composition, from each other respectively through melt-spinning holes for the two types of polyesters to separately provide two types of undrawn polyester multifilaments;

combining the two different types of multifilaments with each other, while subjecting the two different types of multifilaments to a filament-intermingling treatment in which an air blast is applied to the combined multifilaments under an air pressure of 50 to 600 kPa, to intermingle the individual multifilaments with each other;

taking up the resultant combined, intermingled multifilament bundle;

drawing the multifilament bundle at a draw ratio of 1.2 to 2.5, to provide a combined, intermingled and drawn multifilament yarn comprising two types of drawn multifilament different in thermal shrinkage from each other; and applying a heat texturizing treatment to the drawn multifilament yarn to such an extent that a type of resultant texturized multifilaments FYB have an average filament length under straightened condition of 8 to 40% longer than that of the other type of the resultant texturized multifilaments FYA, in the resultant multifilament yarn FY, the shorter individual multifilaments FYA exhibit a coefficient of variation ($CV_A$) in filament length under straightened condition of 3% or less, and a coefficient of variation ($CV_{B-A}$) in difference between the filament lengths of the longer individual multifilaments FYB and the average filament length of the shorter individual multifilaments FYA, each under a straightened condition, is in the range of from 10 to 20%.

In the process of the present invention, it is important that a filament-intermingling treatment using an air blast under an air pressure of 50 to 600 kPa is applied to the combined multifilaments, to intermingle the individual multifilaments with each other and to control the combination of the two different types of multifilaments to an appropriate degree.

In the process of the present invention, two types of polyester resins different in chemical composition from each other are separately melt-spun through melt-spinning holes for the two different types of polyester resins to provide two types of undrawn, non-bundled polyester multifilaments different in chemical composition and thus elongation and thermal shrinkage from each other. Then, the two types of melt-spun, undrawn, multifilaments are unbundled and are combined with each other to provide a combined multifilament bundle. In this process, before the combining procedures, the two types of separately melt-spun multifilaments are unbundled and thus, in the combining procedure, the two types of multifilaments can be evenly mixed with each other. If each type of melt-spun multifilaments are bundled before the combining procedure, the two types of the multifilaments cannot be evenly mixed with each other in the combining procedure. This phenomenon is similar to that occurring in the conventional process using the separately wound multifilament yarns which are independent from each other.

Then, in the process of the present invention, during the combining procedure, an air blast is applied to the two different types of multifilaments under an air pressure of 50 to 600 kPa, to intermingle the combined individual multifilaments with each other, to disturb the even combination of the two types of multi-filaments and to intermingle the individual multifilaments with each other. If the two different types of melt-spun multifilaments are combined, the combined multifilaments are taken up, and then the combined multifilaments are subjected to the filament-intermingling treatment with the air blast, the resultant combined, intermingled multifilament yarn exhibits the a $CV_{B-A}$ similar to that in a texturized, combined multifilament yarn produced from the conventional melt-spun, combined multi-filament yarns without applying the filament-intermingling treatment with the air blast. The change in the combining condition of the combined two different types of multifilaments due to the position at which the filament-intermingling treatment with the air blast is not fully clarified. However, in the case where the two different types of polyester resins are separately melt-spun, and the resultant two different types of multifilaments are taken up through a first godet roll and then wound through a second godet roll by a winder, the following is assumed.

When the filament-intermingling treatment with the air blast is applied upstream to the first godet roll, the melt-spun multifilaments are incompletely bundled by a filament guide, because if they are completely bundled, too high a friction between the filament guide and the filament bundle is generated, and thus the individual multifilaments are spaced from each other to a certain extent, and then the filament-intermingling treatment with the air blast is applied to the multifilaments. Thus the evenly combined condition of the two different types of melt-spun multifilaments is disturbed. In other words, the filament-intermingling treatment with the air blast serves to regularly arrange the multifilaments FYA in the core portion and the multifilaments FYB in the sheath layer of the combined multifilament bundle.

If the filament-intermingling treatment with the air blast is applied downstream of the first godet roll, the multifilaments are pressed to the first and second godet rolls, and thus the movements of the individual multifilaments relative to each other are restricted and the spaces between the individual multifilament are decreased. In other words, the density of the multifilament bundle is increased. When the filament-intermingling treatment by the air blast is applied to the dense multifilament bundle, due to an interference of the multifilaments to each other, the rearrangement of the multifilaments is hindered and thus the multifilament bundle is maintained in a uniformly combined condition.

Also, in the process of the present invention the pressure of the air blast applied to the two different types of multifilament in the combining procedure is important. If the air blast pressure is less than 50 kPa, even when the two different types of multifilaments are loosely bundled, the rearrangement of the multifilaments in the loose bundle cannot be sufficiently effected, and the combining condition of the two different types of multifilaments is made more uniform.

When the air blast pressure is more than 600 kPa, the rearrangement effect on the multifilaments is saturated, and the multifilament bundles are significantly vibrated to cause fluffs to be formed and filament breakage to occur. In the process of the present invention, the filament-intermingling treatment using the air blast is preferably carried out by a interlacing method.

The process of the present invention will be further explained below. The melt-spun multifilaments are produced by the following procedures.

The melt-spinning holes for the two different types of the multifilaments may be formed in two separate melt-spinnerets as long as the two different types multifilaments melt-spun through the separate spinnerets can be combined to form a multifilament bundle without separately bundling two different types of multifilaments and combining the bundled two different types of multifilaments into a yarn. However, preferably, the melt-spinning holes for two different types of multifilaments are formed in one single melt-spinneret. In this case, the two different types of melt-spun multifilaments are easily combined with each other before bundling, and the number of the mult-spinnerets can be reduced by half.

The polyesters usable for producing the two different types of multifilaments are as mentioned above. When a filament elongation-enhancing agent is mixed into a polyester resin for the longer multifilaments FYB to increase the elongation property of the longer multifilament FYB, preferably, the ultimate elongation of one type of undrawn multifilaments is controlled to 1.5 times, or more, more preferably 2 to 3.5 times, that of the other one undrawn multifilaments. If the ultimate elongation ratio is less than 1.5, it may be difficult to control the filament length difference between the shorter multifilaments FYA and the longer multifilaments FYB to a level sufficient to attain the object of the present invention, during the drawing and heat treatment procedures.

The procedure for producing a drawn, combined multifilament yarn will be explained below. The drawing procedure can be carried out by a draw-false twisting method in which a drawing procedure and a false twisting procedure are simultaneously applied to a undrawn, combined multifilament yarn or by a drawing method in which a false twisting procedure is not applied to the yarn. The draw-false twisting method is preferably applied to the undrawn, combined multifilament yarn in which two types of undrawn multifilaments are different in elongation property, and the drawing method is preferably applied to the undrawn, combined multifilament yarn in which two types of undrawn multifilaments are different in both elongation property and thermal shrinkage property. In the drawing procedure, in either method, the draw ratio is controlled to 1.2 to 2.5, preferably 1.5 to 2.3, to cause the resultant texturized, combined polyester multifilament yarn to have a satisfactory average filament length difference between the shorter and longer multifilaments. The draw-false twisting method for the undrawn, combined multifilament yarn of the present invention can be carried out under conventional conditions by using conventional apparatus. For example, a heating means may be arranged only upstream of the false twisting device, or another heating means may be further arranged downstream from the false twisting device, to relax the crimps of the yarn formed by the false twisting procedure.

In both the draw-false twisting procedure and the drawing procedure including no false twisting treatment, before or after the procedure, an additional filament-intermingling treatment using air blast may be applied to the yarn, unless this treatment causes the resultant textured, combined multifilament yarn to exhibit a degraded hand. After the combining procedure and the filament-intermingling treatment are simultaneously applied to the melt-spun multifilaments, the individual multifilaments are difficult to be rearranged.

Thus, the additional filament-intermingling treatment contributes to enhancing the intermingle of the multifilaments with each other without causing the sheath layer to slip from the core portion of the combined yarn, before or after the drawing procedure.

In the drawn, combined multifilament yarn, the two types of multifilaments are different in thermal shrinkage from each other.

In the process of the present invention, the drawn, combined multifilament yarn is subjected to a heat texturizing treatment which is carried out to such an extent that the resultant texturized multifilaments FYB have an average filament length under straightened condition of 10 to 40% longer than that of the other resultant texturized multifilaments FYA, in the resultant multifilament yarn FY, the shorter individual multifilaments FYA exhibit a coefficient of variation ($CV_A$) in filament length under straightened condition of 3% or less, and a coefficient of variation ($CV_{B-A}$) in difference between average filament length of the longer individual multifilaments FYB and the shorter individual multifilaments FYA, each under straightened condition, is in the range of from 10 to 20%.

The heat texturizing treatment contributes to improving the weaving and knitting property of the texturized, combined multifilament yarn of the present invention.

After the texturized, combined multifilament yarn of the present invention is subjected to a weaving or knitting procedure, the resultant woven or knitted fabric is preferably subjected to a heat treatment in a hot water at a temperature of 60° C. or more, preferably 70 to 130° C., or in a wetted air atmosphere at a temperature of 80 to 120° C. or in a dry air atmosphere at a temperature of 80 to 150° C., preferably in a relaxed condition.

In the case where a filament elongation-enhancing agent is contained in the longer multifilaments FYB, and a drawing procedure free from a false twisting treatment is applied, preferably, before the above-mentioned heat treatment, an additional heat treatment is applied to the woven or knitted fabric on a plate heater at a temperature of about 190° C. under a relaxed condition under which the fabric is allowed to shrink at a shrinkage of 2 to 5%, to allow the longer multifilaments to spontaneously elongate during the additional heat treatment. This additional heat treatment contributes to further enhancing the bulkiness of the resultant woven or knitted fabric.

EXAMPLES

The present invention will be further explained by the following examples which are not intended to limit the scope of the present invention.

In the examples and comparative examples, the average filament length, the coefficient ($CV_{B-A}$) of variation of filament length difference, coefficient ($CV_A$) of variation of shorter multifilament FYB length, glass transition temperature and thermal deformation temperature of polyester resin, ultimate elongation of filament, intrinsic viscosity of polyester resin, shrinkage of filament in boiling water (BWS), percentage of crimp of filament, bulkiness of yarn, hand of fabric, and appearance of fabric were determined by the measurements shown below.

(1) Average Filament Length

Three specimens of a combined multifilament yarn were treated in hot water at a temperature of 100° C. under no load for 30 minutes, dried at room temperature for one day, and then cut into a length of 5 cm under a load of 1/30 g per dtex of the yarn. The cut specimens were separated into individual multifilaments FYA and FYB. The lengths of the separated individual filaments were measured under a load of 0.1 g per dtex of the filament. An average filament length was calculated from the measured data.

(2) Coefficient of Variation of Filament Length Difference ($CV_{B-A}$ in %)

The filament lengths of the longer individual multifilaments FYB and the average filament length of the shorter individual multifilaments FYA measured in the above-mentioned measurement (1) were utilized.

The filament length difference in % was calculated in accordance with the following equation.

$$\text{Filament length difference } (\%) = [(\text{Individual } FYB \text{ filament length } (L_A) - \text{Average } FYA \text{ filament length})/(\text{average } FYA \text{ filament length } (L_A))] \times 100$$

Standard deviation ($S_{B-A}$) of the calculated filament length differences and average filament length difference $\Delta L$ between the multifilaments FYB and FYA were calculated.

The coefficient of variation ($CV_{B-A}$ in %) of the filament length difference between the multifilament was calculated in accordance with the following equation $$CV_{A-B}(\%) = (S_{B-A}/\Delta L) \times 100$$

(3) Coefficient of Variation $CV_A$ in %) of Filament Length of Shorter Multifilaments FYA Based on the measured values of the filament lengths of individual shorter multifilaments FYA, the standard deviation ($S_A$) in the filament length and average filament length ($L_A$) of the shorter multifilaments FYA were calculated. The coefficient of variation $CV_A$ in % in the filament length of the multifilaments FYA was calculated in accordance with the following equation.

$$CV_A(\%) = (S_A/L_A) \times 100$$

(4) Glass Transition Temperature and Thermal Deformation Temperature

The above-mentioned temperatures were determined in accordance with ASTM D-648.

(5) Ultimate Elongation

A melt spun multifilament yarn was left to stand in a constant temperature constant humidity chamber at a temperature of 25° C. at a humidity of 60% for one day and night. A specimen of the multifilaments having a length of 100 mm was subjected to a tensile test using a tensile tester (made by SHIMAZU SEISAKUSHO) at a stretching velocity of 200 m/min. The tensile strength and the ultimate elongation of the specimen were measured.

The drawn combined multifilament yarn and the texturized, combined multifilament yarn were subjected to the similar tensile test to that mentioned above, except that the lengths of the specimens were 200 mm and the stretching speed was 200 m/min.

(6) Intrinsic Viscosity [η] of Polyester Resin

The intrinsic viscosity [η] of polyester resin was determined in a solvent consisting of o-chlorophenol at a temperature of 35° C. In the determination, a sample of the polyester resin was dissolved in various concentrations (C) in o-chlorophenol and the viscosities of the resultant solutions were measured, and from the obtained data, the intrinsic viscosity [η] of the polyester resin was determined.

(7) Shrinkage in Boiling Water (BWS)

A specimen of a yarn was wound ten times around a yarn length meter (having a peripheral length of 1125 cm), and wound yarn was removed from the yarn length meter to provide a hank of the yarn. The length ($L_o$) of the hank was measured under a load of 1/30g per 1.11 dtex (denier). After the hank was released from the load, the hank was heat treated in hot water at a temperature of 95° C. from 30 minutes and dried.

The dried hank was loaded under the same conditions as mentioned above, and the length (L) of the hank was measured.

The shrinkage of the yarn in boiling water (BWS) in % was calculated in accordance with the following equation.

$$BWS(\%)=[(L_0-L)/L]\times 100$$

(8) Percentage of Crimp

A hank of a yarn was prepared in a thickness of 3000 dtex and loaded with a light weight of 6 g (2 mg/dtex) and a heavy weight 600 g (0.2 g/dtex). One minute after the start of the loading, the length of the hank ($L_0$) was measured and it was measured again immediately the heavy weight was removed from the hank. The hank loaded only with the light weight was supported by a guide rod and immersed in boiling water for 20 minutes. Then, the light weight was removed from the hank and the hank was naturally dried for one day or more. Thereafter, the hank was loaded with both the light and the heavy weights and one minute after the loading, the length ($L_1$) of the hank was measured, then the heavy weight was removed from the hank, and the length ($L_2$) of the hank was measured. The percentage of crimp was calculated in accordance with the following equation.

$$\text{Percentage of crimp } (\%)=[(L_1-L_2)/L]\times 100$$

(9) Bulkiness

The texturized, combined polyester multifilament yarns comprising the shorter and longer multifilaments FYA and FYB for which the combing conditions of the melt-spun multifilaments were compared based on the shrinkages of the texturized multifilaments, were converted to woven fabrics in which the warp and weft densities were designed so that the resultant woven fabrics have the same basis weight, as each other, in consideration of the shrinkages of the yarns. The woven fabrics were after-treated under the same conditions. The bulkinesses of the finished woven fabrics were calculated from the thicknesses and the basis weights of the fabrics.

(10) Hand

The finished woven fabric was subjected to an organoleptic test of the hand of the fabrics by five skilled panel numbers. The test results were classified as follows.

| class | Hand |
|---|---|
| 3 | Sufficiently bulky and soft |
| 2 | Bulkiness is slightly insufficient and softness is poor |
| 1 | Bulkiness is poor and fabric is stiff |

(11) Appearance

The appearance of the woven fabrics were evaluated in an organoleptic test by five skilled testers. The test results were classified as follows.

| class | Appearance |
|---|---|
| 3 | Surface is very uniform and smooth. No roughness is found. |
| 2 | Slight roughness is found on the surface, but no longitudinal stripe or unevenness are found. |
| 1 | Surface is significantly rough and, in parts of the surface, longitudinal stripes and unevenness are found. |

Examples 1 to 4 and Comparative Examples 1 to 3

In each of Examples 1 to 4 and Comparative Examples 1 to 3, a melt-spinneret having a group A of spinning nozzles (with a nozzle diameter of 0.4 mm, a nozzle length of 0.8 mm and the number of the nozzles of 12) for the shorter multifilaments FYA and a group B of spinning nozzles (with a Y-shaped nozzle slit having a slit width of 0.18 mm and a length of each of the three branches of the Y-shaped slit of 0.54 mm, a nozzle length of 0.8 mm and the number of the nozzles of 24) for the longer multifilaments FYB was provided.

In the spinneret, the resin melt flow paths of the spinning nozzles do not intersecte with each other.

A polyethylene terephthalate resin having an intrinsic viscosity of 0.64 and a chip blend of the same polyethylene terephthalate resin as mentioned above with a filament elongation-enhancing agent consisting of a methacrylic resin (trademark: Kurapet SH-N, Color No. 1000) in an amount of 2% by weight based on the weight of the polyester resin were separately melt-extruded through the group A of the spinning nozzles and the group B of the spinning nozzles of the spinneret at a spinneret temperature of 283° C., and the extruded multifilaments were taken up at a taking-up speed of 3300 m/min. A melt spun, combined multifilament yarn having a yarn count of 140 dtex/36 filaments was obtained. In this melt-spun, undrawn multifilament yarn, the multifilaments for the FYA had a yarn count of 50 dtex/12 filaments, an ultimate elongation of 135% and a circular cross-sectional profile, and the multifilaments for the FYB had a yarn count of 90 dtex/24 filaments, an ultimate elongation of 320% and a triangular cross-sectional profile. In the melt-spinning apparatus, an interlacing device is arranged between a take-up godet roll and a bundling guide located upstream to the take-up godet roll, and air blast was applied to the melt-spun multifilaments under pressure as shown in Table 1. The taken-up undrawn multifilament yarn was drawn and heat-set through a drawing apparatus having a feed roller, a first taking up roller, a second taking up roller and a winder and free from false twisting device, to prepare drawn, combined multifilament yarn. In this drawing procedure, an interlacing device was arranged between the feed roller and the first taking up roller having a peripheral temperature of 115° C., and the combined multifilament yarn was fed to the interlacing device at a feed speed of 800 m/minute at an overfeed of 2%, and the multifilaments in the yarn were intermingled by air blast spouted from the interlacing device under a pressure of 200 Pa.

Also, between the first taking up roll and the second taking up roll, the combined multifilament yarn was drawn at a draw ratio of 1.75 after passing through a slit heater having a path length of Im at a temperature of 230° C. Then the resultant drawn, combined multifilament yarn was wound to from a yarn package.

The texturized, combined polyester multifilament yarn was converted to a satin woven fabric having a basis weight of 100 g/m$^2$ and the resultant woven fabric was finished through a pre-relaxing treatment, a final relaxing treatment, a pre-setting treatment; a 15% weight reduction alkali treatment, a dyeing procedure at a temperature at 130° C. and a final heat setting treatment.

After the final heat setting treatment was applied, the resultant fabric was taken to pieces, namely warp yarns and weft yarns. The obtained yarns were subjected to the above-mentioned tests. The test results are shown in Table 1.

Comparative Example 4

A texturized, combined polyester multifilament yarn and a woven fabric was produced by the same procedures as in Example 1, except that the melt-spun multifilaments for the FYA and FYB were separately wound up without applying the filament-interlacing treatment to the melt-spun multifilaments, and the separately wound multifilament bundles were combined with each other in the filament-interlacing treatment applied during the drawing procedure.

The fabric and the texturized, combined multifilament yarns obtained from the final heat-set fabric were subjected to the above-mentioned tests.

The test results are shown in Table 1.

TABLE 1

| | Texturized, combined polyester multifilament yarn | | | | | | | Fabric | | | | |
|---|---|---|---|---|---|---|---|---|---|---|---|---|
| | | Average individual filament thickness | | | | | | | | | | |
| Item Example No | Air blast pressure (kPa) | FYA (detx) | FYB (dtex) | ΔL % | $CV_{B-A}$ % | $CV_A$ % | Percentage of Crimp % | Basis weight (g/m$^2$) | Thickness (mm) | Bulkiness (cm$^3$/g) | Hand | Appearance |
| Comparative Example | | | | | | | | | | | | |
| 1 | 0 | 2.2 | 2.1 | 14.5 | 25 | 2.4 | 0.4 | 102 | 0.195 | 1.91 | 1 | 1 |
| 2 | 30 | 2.2 | 1.9 | 15.2 | 22 | 1.9 | 0.3 | 103 | 0.227 | 2.20 | 2 | 2 |
| Example | | | | | | | | | | | | |
| 1 | 50 | 2.3 | 2.0 | 10.3 | 17 | 2.3 | 0.4 | 99 | 0.207 | 2.09 | 3 | 3 |
| 2 | 150 | 2.2 | 2.0 | 9.4 | 13 | 2.4 | 0.3 | 101 | 0.232 | 2.30 | 3 | 3 |
| 3 | 400 | 2.3 | 2.1 | 8.8 | 10 | 2.2 | 0.4 | 102 | 0.244 | 2.39 | 3 | 3 |
| 4 | 600 | 2.1 | 2.0 | 12.9 | 15 | 2.5 | 0.4 | 100 | 0.224 | 2.24 | 3 | 3 |
| Comparative Example | | | | | | | | | | | | |
| 3 | 700 | 2.3 | 2.1 | 14.6 | 21 | 2.2 | 0.5 | 104 | 0.219 | 2.11 | 2 | 2 |
| 4 | — | 2.4 | 1.8 | 15.5 | 29 | 2.4 | 0.4 | 104 | 0.224 | 2.15 | 1 | 2 |

Examples 5 to 8 and Comparative Examples 5 to 7

In each of Examples 5 to 8 and Comparative Examples 5 to 7, a texturized, combined polyester multifilament yarn and a woven fabric were produced by the same procedures as in Example 1 with the following exceptions.

The melt-spinneret of Example 1 was replaced by a spinneret having a group A of spinning nozzles (with a nozzle diameter of 0.4 mm, a nozzle length of 0.8 mm and the number of the nozzles 15) and a group B of spinning nozzles (with a nozzle diameter of 0.33 mm, a nozzle length of 0.8 mm, and the number of nozzles of 48.

The same polyester resins as those in Example 1 were melt-spun through the spinneret, and the resultant melt-spun, combined multifilament yarn was taken up at a taking up speed of 3300 m/minute. The resultant melt-spun combined multifilament yarn had a yarn count of 265 dtex/63 filaments and comprised melt-spun multifilaments for the FYA, the melt-spun, combined multifilament yarn comprised the group A of melt-spun multifilaments for the FYA having a yarn count of 115 detx/15 filaments, an ultimate elongation of 135% and a circular cross-sectional profile, and the group B of melt-spun multifilaments for the FYB having a yarn count of 150 detx/48 filaments, an ultimate elongation of 320% and a circular cross-sectional profile. In the melt-spinning, combining procedures, an interlacing device was arranged between the taking up godet roll and a bundling guide located upstream to the godet roll and the filament-intermingling treatment was applied to the melt-spun multifilaments by the air blast supplied from the interplacing device under the air pressure as shown in Table 2.

The melt-spun, combined multifilament yarn was fed into a draw-false twisting apparatus having a heater and a false twisting device arranged downstream from the heater and having a friction disc. In the draw-false twisting procedure, the fed yarn was heated by the heater at a temperature of 160° C. and then false-twisted by the false-twisting device at a ratio D/Y of 1.9 wherein D represents a peripheral speed of the friction disc and Y represents a passing speed of the yarn, while the yarn was drawn at a drawn ratio of 1.6, to provide a drawn, false-twisted yarn.

From the drawn, false-twisted yarn, a twill fabric having a basis weight of 220 g/m$^2$ was produced and finished through a pre-relaxing treatment, a final relaxing treatment, a pre-heat setting treatment, a 20% weight reduction alkali treatment, a dyeing procedure at a temperature of 130° C. and a final heat-setting procedure.

The final set fabric was taken to pieces, namely the warp yarns and the weft yarns. The fabric and the taken texturized, combined polyester multer filament yarns were tasted by the above-mentioned tasting methods. The test results are shown in Table 2.

Comparative Example 8

A texturized, combined polyester multifilament yarn and a woven fabric were produced and tested by the same procedures as in Example 5 with the following exceptions.

The two types of melt-spun multifilament bundles are separately taken up and wound, without applying the filament interlacing treatment to the multifilaments, and the multifilament bundles were combined with each other during the false-twisting treatment in the draw-false twisting procedure.

The resultant final heat-set fabric and the texturized, combined multifilaments yarns taken from the fabric were subjected to the above-mentioned tests.

The test results are shown in Table 2.

Example 9

A texturized, combined polyester multifilament yarn and a fabric were produced and tested by the same procedures as in Example 3, with the following exceptions.

The polyester resin for the FYA containing no filament elongation-enhancing agent was replaced by a copolyester resin containing isophthalic acid residue substituting thereby 5 molar % of terephthatic acid residue of the polyethylene terephthalate resin, and having an intrinsic viscosity of 0.64.

The test results of the fabric and the texturized, combined polyester multifilament yarns taken from the fabric are shown in Table 3.

Example 10

A texturized, combined polyester multifilament yarn and a woven fabric were produced and tested by the same procedures as in Example 9 with the following exceptions.

In the copolyester resin for the FYA, the substitution by the isophthalic acid residue was changed from 5 molar % to 10 molar %.

The test results of the final heat-set fabric and the texturized, combined polyester multifilament yarns taken from the fabric are shown in Table 3.

TABLE 2

| | Texturized, combined polyester multifilament yarn | | | | | | | Fabric | | | | |
|---|---|---|---|---|---|---|---|---|---|---|---|---|
| | | Average individual filament thickness | | | | | | | | | | |
| Item Example No | Air blast pressure (kPa) | FYA (detx) | FYB (dtex) | ΔL % | $CV_{B-A}$ % | $CV_A$ % | Percentage of Crimp % | Basis weight (g/m$^2$) | Thickness (mm) | Bulkiness (cm$^3$/g) | Hand | Appearance |
| Comparative Example | | | | | | | | | | | | |
| 5 | 0 | 5.0 | 1.58 | 28.9 | 28 | 1.5 | 6.7 | 0.505 | 221 | 2.28 | 1 | 1 |
| 6 | 30 | 5.0 | 1.55 | 31.0 | 26 | 1.8 | 7.1 | 0.513 | 224 | 2.29 | 2 | 2 |
| Example | | | | | | | | | | | | |
| 5 | 50 | 5.0 | 1.59 | 28.5 | 14 | 2.4 | 6.4 | 0.534 | 220 | 2.43 | 3 | 3 |
| 6 | 250 | 4.9 | 1.66 | 22.8 | 12 | 2.2 | 6.9 | 0.538 | 225 | 2.39 | 3 | 3 |
| 7 | 450 | 5.0 | 1.68 | 21.4 | 10 | 2.4 | 6.8 | 0.545 | 226 | 2.41 | 3 | 3 |
| 8 | 600 | 5.1 | 1.66 | 23.1 | 18 | 2.2 | 7.2 | 0.551 | 223 | 2.47 | 3 | 3 |
| Comparative Example | | | | | | | | | | | | |
| 7 | 700 | 5.0 | 1.57 | 29.5 | 25 | 1.8 | 6.8 | 0.521 | 222 | 2.35 | 2 | 2 |
| 8 | — | 5.1 | 1.60 | 27.6 | 33 | 2.0 | 7.0 | 0.504 | 225 | 2.24 | 1 | 3 |

TABLE 3

| Item Example No | Texturized, combined polyester multifilament yarn: Average individual filament thickness FYA (detx) | FYB (dtex) | ΔL % | $CV_{B-A}$ % | $CV_A$ % | Percentage of Crimp % | Fabric: Basis weight (g/m²) | Thickness (mm) | Bulkiness (cm³/g) | Hand | Appearance |
|---|---|---|---|---|---|---|---|---|---|---|---|
| Example | | | | | | | | | | | |
| 9 | 2.2 | 2.0 | 9.4 | 13 | 2.4 | 0.3 | 101 | 0.232 | 2.30 | 3 | 3 |
| 10 | 2.1 | 2.1 | 17.8 | 10 | 2.2 | 0.4 | 102 | 0.267 | 2.62 | 3 | 3 |

In the process for producing the texturized, combined polyester multifilament yarn of the present invention the two different types of melt-spun, combined multifilaments are subjected to a filament intermingling treatment in which an air blast is applied to the multifilaments under an air pressure of 50 to 600 kPa, before taking up and thus, the melt-spun multifilaments are intermingled in an appropriate combining condition which is between that obtained by using the conventional separately wound multifilaments and that obtained by using the conventional melt-spun, combined multifilaments. Thus, in the texturized, combined polyester multifilament yarn of the present invention, the sheath layer mainly formed from the longer multifilaments FYB is stably fixed to the core portion mainly formed from the shorter multifilament FYA and slippage between the sheath layer and the core portion, which occurs when the combined multifilament yarn is formed from the conventional separately wound multifilaments, does not occur, and the reduction in the bulkiness which occurs when the conventional melt-spun, combined multifilaments are employed, does not occur even when the filament length difference is relatively small. Also, the breakage of the gaps formed between the sheath layer and the core portion, which occurs when the conventional separately wound multifilaments are employed, can be prevented by the appropriate scattering of the filament length of the longer multifilaments FYB for the sheath layer. Thus, the texturized, combined polyester multifilament yarn of the present invention is an excellent bulky yarn having a higher bulkiness than that of the conventional bulky yarn produced from the separately wound multifilaments.

The fabric made from the texturized, combined polyester multifilament yarn of the present invention is free from yarn slippage and is useful for blouses, suits, dresses or skirts which must have an appropriate bulkiness and a high flexibility.

What is claimed is:

1. A texturized, combined polyester multifilament yarn, comprising two types of texturized polyester multifilaments FYA and FYB different in polymer chemical composition thereof from each other and combined and portially intermingled with each other to form a combined multifilament yarn FY, wherein average filament length under a straightened condition of the individual multifilaments FYB is 8 to 40% longer than that of the individual multifilaments FYA in the combined multifilament yarn FY, the shorter individual multifilaments FYA have a coefficient of variation ($CV_A$) in filament length, under a straightened condition, of 3% or less, and a coefficient of variation ($CV_{B-A}$) in difference between the individual filament lengths of the longer individual multifilaments FYB and the average filament length of the shorter individual multifilaments FYA, each under a straightened condition, is in the range of from 10 to 20%.

2. The textured, combined polyester multifilament yarn as claimed in claim 1, wherein the average filament length under a straightened condition of the individual multifilament FYB is 10 to 40% longer than that of the individual multifilaments FYA.

3. The texturized, combined polyester multifilament yarn as claimed in claim 1, wherein the longer multifilaments FYB contains a filament elongation-enhancing agent in an amount of 0.5 to 5% by weight based on the weight of the polyester polymer contained in the longer multifilaments FYB.

4. The texturized combined polyester multifilament yarn as claimed in claim 3, wherein the filament elongation-enhancing agent comprises an addition polymerization product of at least one unsaturated monomer, which product is substantially insoluble in the polyester in the longer individual filaments FYB and has a weight average molecular weight of at least 2000.

5. The texturized, combined polyester multifilament yarn as claimed in any of claims 1 to 4, wherein the polyester contained in the shorter individual multifilaments FYA contains, as a portion of residue of dicarboxylic acid component for forming the polyester, isophthalic acid residue in an amount of 3 to 15 molar % of the total content of dicarboxylic acid residues.

6. The texturized combined polyester multifilament yarn as claimed in claim 1, 2, 3 or 4, wherein the longer polyester multifilaments FYB have an average individual filament thickness corresponding to 80% or less of that of the shorter polyester multifilaments FYA, and the number of the longest polyester multifilaments FYB is at least 1.5 times that of the shorter polyester multifilaments FYA, per one combined multifilament yarn FY.

7. A process for producing a texturized, combined polyester multifilament yarn, comprising:

separately melt-spinning two types of polyesters different in chemical composition from each other respectively through melt-spinning holes for the two types of polyesters to separately provide two types of undrawn polyester multifilaments;

combining the two different types of multifilaments with each other while subjecting the combined multifilaments to a filament-intermingling treatment in which an air blast is applied to the combined multifilaments under an air pressure of 50 to 600 kPa, to intermingle the individual multifilaments with each other;

taking up the resultant combined, intermingled multifilament bundle;

drawing the multifilament bundle at a draw ratio of 1.2 to 2.5, to provide a combined, intermingled and drawn multifilament yarn comprising two types of drawn multifilament different in thermal shrinkage from each other; and applying a heat texturizing treatment to the drawn multifilament yarn to such an extent that a type of resultant texturized multifilaments FYB have an average filament length, under a straightened condition, 8 to 40% longer than that of the other type of the resultant texturized multifilaments FYA, in the resultant multifilament yarn FY, the shorter individual multifilaments FYA exhibit a coefficient of variation ($CV_A$) in filament length, under a straightened condition, of 3% or less, and a coefficient of variation ($CV_{B-A}$) in difference between the individual filament lengths of the longer individual multifilaments FYB and the average filament length of the shorter individual multifilaments FYA, each under a straightened condition is in the range of from 10 to 20%.

8. The process as claimed in claim 7, wherein the texturized multifilaments FYB have an average filament length, under a straightened condition, 10 to 40% longer than that of the texturized multifilaments FYA.

9. The process as claimed in any of claims 7 and 8, wherein the air filament-intermingling treatment is effected by an interlace method.

10. The process as claimed in claim 7 or 8, wherein the spinning holes for the two types of polyesters are formed in one single spinneret plate.

* * * * *